US007913591B2

(12) United States Patent
Nenadic

(10) Patent No.: US 7,913,591 B2
(45) Date of Patent: Mar. 29, 2011

(54) MULTIPURPOSE TOOL

(75) Inventor: John Nenadic, Camas, WA (US)

(73) Assignee: Leatherman Tool Group, Inc., Portland, OR (US)

( * ) Notice: Subject to any disclaimer, the term of this patent is extended or adjusted under 35 U.S.C. 154(b) by 0 days.

(21) Appl. No.: 11/621,739

(22) Filed: Jan. 10, 2007

(65) Prior Publication Data

US 2008/0163433 A1 Jul. 10, 2008

(51) Int. Cl.
*B25B 7/22* (2006.01)
*B25F 1/04* (2006.01)
*B26B 11/00* (2006.01)

(52) U.S. Cl. ..... 81/427.5; 7/168; 7/128; 7/118

(58) Field of Classification Search ..... 81/427.5, 81/177.4, 490; 7/128, 118, 168, 158; 16/110.1, 16/111.1

See application file for complete search history.

(56) References Cited

U.S. PATENT DOCUMENTS

| | | | | |
|---|---|---|---|---|
| 18,206 | A * | 9/1857 | Lamson | 7/128 |
| 187,483 | A | 2/1877 | Rightor | |
| 345,296 | A | 7/1886 | Friebertshauser | |
| 364,414 | A | 6/1887 | Hollweg | |
| 610,530 | A | 9/1898 | Hammesfahr | |
| 825,093 | A | 7/1906 | Watson | |
| 1,179,111 | A * | 4/1916 | Knowlton | 30/155 |
| 1,273,026 | A | 7/1918 | Brown | |
| 1,800,843 | A | 4/1931 | Moulton | |
| 2,250,290 | A | 7/1941 | Berg | |
| 2,263,415 | A | 11/1941 | Berg et al. | |
| 2,597,540 | A | 5/1952 | Smith | |
| 2,718,695 | A | 9/1955 | Elsener | |
| 2,809,384 | A | 10/1957 | Kayser | |
| 3,363,315 | A | 1/1968 | Anderson | |
| 3,832,775 | A | 9/1974 | Stahel, II et al. | |
| 4,187,607 | A | 2/1980 | Simuro et al. | |
| 4,238,862 | A | 12/1980 | Leatherman | |
| 4,512,051 | A | 4/1985 | Magan | |

(Continued)

FOREIGN PATENT DOCUMENTS

EP 0 771 622 A1 5/1997

(Continued)

OTHER PUBLICATIONS

Van Hoy Snap Lock, available at http://www.crkt.com/snaplock.html (Jul. 5, 2006), 2 pages.

(Continued)

*Primary Examiner* — Hadi Shakeri
(74) *Attorney, Agent, or Firm* — Alston & Bird LLP

(57) ABSTRACT

A multipurpose tool is provided that includes a carabiner and that is designed to fold into a closed position that is relatively compact. As such, the carabiner of the multipurpose tool can be utilized to secure the multipurpose tool to a user, such as to a belt loop or the like, while permitting the multipurpose tool to be folded into a compact form. A handle that includes a carabiner and that can be utilized by such a multipurpose tool as well as a method of forming the handle are also provided. Still further, a multipurpose tool is provided that includes a handle defining a pocket for storing at least one bit in instances in which the bit is not engaged by the bit driver, thereby reducing the likelihood that the bit will be lost or otherwise separated from the multipurpose tool.

21 Claims, 11 Drawing Sheets

U.S. PATENT DOCUMENTS

| | | | | |
|---|---|---|---|---|
| 4,563,813 | A | 1/1986 | Fortenberry | |
| 4,570,341 | A | 2/1986 | Konneker | |
| 4,744,272 | A | 5/1988 | Leatherman | |
| 4,759,645 | A | 7/1988 | Kuo | |
| 4,776,094 | A | 10/1988 | Glesser | |
| 4,805,303 | A | 2/1989 | Gibbs | |
| 4,888,869 | A | 12/1989 | Leatherman | |
| 5,142,721 | A | 9/1992 | Sessions et al. | |
| 5,251,353 | A * | 10/1993 | Lin | 7/128 |
| 5,267,366 | A | 12/1993 | Frazer | |
| 5,270,909 | A | 12/1993 | Weiss et al. | |
| 5,349,753 | A | 9/1994 | Gaffney | |
| 5,450,670 | A | 9/1995 | Sakai | |
| 5,463,798 | A | 11/1995 | Wurzer | |
| 5,511,310 | A | 4/1996 | Sessions et al. | |
| 5,537,750 | A | 7/1996 | Seber et al. | |
| 5,628,117 | A | 5/1997 | Glesser | |
| 5,653,525 | A | 8/1997 | Park | |
| 5,697,114 | A | 12/1997 | McIntosh et al. | |
| 5,745,997 | A | 5/1998 | Berg et al. | |
| 5,765,247 | A | 6/1998 | Seber et al. | |
| 5,822,867 | A | 10/1998 | Sakai | |
| D405,676 | S | 2/1999 | Rivera | |
| 5,983,686 | A | 11/1999 | Lee | |
| 6,006,385 | A | 12/1999 | Kershaw et al. | |
| 6,014,787 | A | 1/2000 | Rivera | |
| 6,023,805 | A * | 2/2000 | Lin | 7/128 |
| 6,038,735 | A | 3/2000 | Chang | |
| 6,112,352 | A | 9/2000 | Legg | |
| 6,223,372 | B1 | 5/2001 | Barber | |
| 6,286,397 | B1 * | 9/2001 | Taggart et al. | 81/177.4 |
| 6,341,423 | B1 | 1/2002 | Taggart et al. | |
| 6,470,522 | B2 * | 10/2002 | Veltz et al. | 7/128 |
| D474,095 | S | 5/2003 | Luquire | |
| 6,594,906 | B1 * | 7/2003 | Sakai et al. | 7/118 |
| 6,622,327 | B1 | 9/2003 | Rivera | |
| 6,622,328 | B2 | 9/2003 | Rivera | |
| D484,770 | S | 1/2004 | Green | |
| 7,000,323 | B1 * | 2/2006 | Hatcher et al. | 7/118 |
| 7,126,484 | B1 | 10/2006 | Luquire | |
| D538,138 | S * | 3/2007 | Knight | D8/356 |
| 7,185,569 | B2 * | 3/2007 | Knight et al. | 81/450 |
| 2005/0144730 | A1 * | 7/2005 | Barber et al. | 7/138 |
| 2006/0277762 | A1 | 12/2006 | Knight et al. | |

FOREIGN PATENT DOCUMENTS

| | | | |
|---|---|---|---|
| EP | 0 783 937 | A2 | 7/1997 |
| EP | 1 023 971 | A2 | 8/2000 |
| EP | 1 116 557 | A2 | 7/2001 |
| EP | 1 223 011 | A2 | 7/2002 |
| EP | 1 340 597 | A2 | 9/2003 |
| FR | 2 655 635 | A1 | 6/1991 |
| FR | 2 760 955 | A1 | 9/1998 |
| WO | WO 97/19787 | A1 | 6/1997 |
| WO | WO 98/18599 | A1 | 5/1998 |

OTHER PUBLICATIONS

Delta Folding Knife—EW-04 available from SureFire, available at http://www.surefire.com/maxexp/main/co_disp/displ/carfnbr/317/prrfnbr/24381 (Jul. 5, 2006), 1 page.

Cord/Harness Cutter, available at http://www.surefire.com/surefire/content/ew04_large.jpg, (Jul. 5, 2006), 1 page.

Swiss+Tech Products, available at http://www.swisstechtools.com/productdetail.aspx?PID=pHL7RxHb%2frwA, (Jul. 5, 2006), 1 page.

Serengeti Hunter, available at http://www.crkt.com/serenget.html, (Jul. 5, 2006), 2 pages.

European Search Report for European Patent Application No. 08100265.1; Date of Completion May 9, 2008.

* cited by examiner

MULTIPURPOSE TOOL

FIELD OF THE INVENTION

Embodiments of the present invention relate generally to a multipurpose tool and, more particularly, to a multipurpose tool having an integral carabiner, a handle, such as a handle of the multipurpose tool, having an integral carabiner, an associated method of forming a handle having an integral carabiner, and a multipurpose tool configured to store at least one bit.

BACKGROUND OF THE INVENTION

Multipurpose tools are widely popular for their utility in a substantial number of different applications. As its name suggests, a multipurpose tool includes a number of tools carried by common frame. A multipurpose tool may include different combinations of tools depending upon its intended application. For example, multipurpose tools that are designed for a more universal or generic application can include pliers, a wire cutter, a bit driver, one or more knife blades, a saw blade, a bottle opener or the like. Other multipurpose tools are designed to service more specific applications or niche markets and correspondingly include tools that are useful for the intended application. For example, multipurpose tools may be specifically designed for automobile repairs, hunting, fishing or other outdoor applications, gardening, military applications and the like.

One reason for the popularity of multipurpose tools is the capability provided by a multipurpose tool to provide a wide range of functionality with a single tool, thereby reducing the need to carry a number of different tools to perform those same functions. For example, a single multipurpose tool may be carried instead of a pair of pliers, one or more screwdrivers, a knife and a bottle opener. As such, the burden upon a user is reduced since the user need only carry a single multipurpose tool.

As noted above, one common tool of a multipurpose tool is a bit driver. A bit driver is advantageously designed to receive a variety of different bits in order to increase the functionality of the multipurpose tool. To facilitate the ease of operation by the user, it would also be desirable for the extra bits, that is, the bits not presently engaged by the bit driver, to be stored and carried by the multipurpose tool so as to be readily available to the user and to avoid loss of the bits. As described below, however, it is also desirable for the multipurpose tool to have a compact form such that the storage of the extra bits by the multipurpose tool would desirably not increase the overall size of the multipurpose tool or restrict the capability of the multipurpose tool to assume a compact form.

As multipurpose tools are frequently carried by users in the field it is desirable for the multipurpose tools to be relatively small and lightweight while remaining rugged so as to resist damage. In order to reduce the overall size of a multipurpose tool, some multipurpose tools have been designed to be foldable. In this regard, foldable multipurpose tools are designed to move between a closed position and an open position. Generally, the closed position is more compact with the multipurpose tool frequently being carried in the closed position. Conversely, while the open position is generally less compact than the closed position, the open position generally allows the deployment of one or more of the tools that are stowed and relatively inaccessible when the multipurpose tool is in the closed position.

For example, a multipurpose tool may include pliers having a pair of jaws connected to respective handles. In the open position, the pliers are deployed and capable of being actuated by movement of the handles toward and away from one another. In the closed position, the handles may be folded about the pliers such that the pliers are no longer functional. In the closed position, however, the multipurpose tool is more compact with the form factor generally defined by the proximal relationship of the handles.

Some multipurpose tools include tools that make it more difficult for the multipurpose tool to be as compact as desired, even in the closed position. For example, it is often desirable for a multipurpose tool to include a carabiner. Among other uses, a carabiner can be employed to clip the multipurpose tool to a belt loop or to otherwise secure the multipurpose tool to the user. As it will be apparent, the secure engagement of the multipurpose tool to the user that is provided by a carabiner is particularly useful since multipurpose tools are frequently carried by the user in the field and may become misplaced or otherwise be difficult to locate. A carabiner that is sized to engage a belt loop or the like is large enough, however, that the carabiner may disadvantageously limit the extent to which the multipurpose tool can assume a compact form.

As such, it would be desirable to design a multipurpose tool having a compact configuration, even in instances in which the multipurpose tool includes a carabiner, while maintaining the rugged and relatively lightweight nature of the multipurpose tool.

BRIEF SUMMARY OF THE INVENTION

According to one embodiment, a multipurpose tool is provided that includes a carabiner, but that is designed to fold into a closed position that is relatively compact. As such, the carabiner of the multipurpose tool of this embodiment can be utilized to secure the multipurpose tool to a user, such as to a belt loop or the like, while permitting the multipurpose tool to be folded into a compact form. A handle that includes a carabiner and that can be utilized by such a multipurpose tool as well as a method of forming the handle are also provided according to other aspects of the present invention. Still further, a multipurpose tool of another embodiment is provided that includes a handle defining a pocket for storing at least one bit in instances in which the bit is not engaged by the bit driver, thereby reducing the likelihood that the bit will be lost or otherwise separated from the multipurpose tool.

A multipurpose tool of one embodiment includes a plurality of handles configured for relative movement between a closed position and an open position. The multipurpose tool of this embodiment also includes a plurality of tools carried by at least one of the handles. For example, the tools may include pliers, a bit driver and/or a knife blade. The multipurpose tool of this embodiment also includes a carabiner having first and second sidewalls that are spaced from one another. The carabiner is configured to move in concert with a first one of the handles such that a tool carried by another handle is at least partially disposed within the carabiner between the first and second sidewalls when the handles are in the closed position. As a result of the disposition of a tool at least partially within the carabiner, the compactness of the multipurpose tool is enhanced, at least in the closed position.

The carabiner may be formed by and integral to the first handle, such as at one end of the first handle. The carabiner typically defines an opening into an engagement aperture that is accessible through both the first and second sidewalls. As such, the carabiner may be configured to receive the tool between portions of the first and second sidewalls that are positioned opposite the opening defined by the carabiner.

Although the portions of the first and second sidewalls that receive the tool are free of any direct connection so as to define a gap therebetween that is externally accessible, other portions of the first and second sidewalls, such as those portions proximate to the opening defined by the carabiner, may be interconnected. Additionally, the carabiner may include a gate that extends across the opening.

While the multipurpose tool may include various tools that are designed to at least partially fold into the carabiner, the multipurpose tool of one embodiment includes a bit driver that is at least partially disposed within the carabiner when the handles are in the closed position. Regardless of the type of tool, the multipurpose tool of one embodiment may be designed such that the tool that is at least partially disposed within the carabiner when the handles are in the closed position is disposed at one end of its respective handle. The carabiner and the tool that at least partially folds therein may also be designed to cooperate such that the tool is frictionally engaged by the carabiner when the handles are in the closed position. For example, at least one of the tool or the handle carrying tool may include a projection with the carabiner defining a corresponding recess for engaging the projection when the handles are in the closed position.

As noted above, a handle is provided according to another aspect of the present invention. The handle includes a frame having first and second sidewalls operably connected to one another and forming a carabiner defined by portions of the first and second sidewalls, such as at one end of the frame. The carabiner defines an opening into an engagement aperture that is accessible through both the first and second sidewalls. Those portions of the first and second sidewalls that define the carabiner are spaced apart from one another so as to define an externally accessible gap therebetween. The first and second sidewalls may be interconnected, however, proximate the opening defined by the carabiner. Additionally, the carabiner may include a gate extending across the opening. Still further, the carabiner may include a recess defined by at least one of the first and second sidewalls and configured to mechanically engage a corresponding projection associated with a respective tool.

A method of forming a handle is also provided in accordance with another aspect of the present invention. In this regard, a workpiece is stamped to define the frame having first and second interconnected frame portions. The frame is then bent so as to align the first and second interconnected frame portions and to thereby define corresponding first and second sidewalls they are spaced apart from one another. According to this aspect of the invention, the workpiece is stamped and the frame is bent in such a manner to form a carabiner that is defined by portions of the first and second sidewalls, such as at one end of the frame. The carabiner, in turn, defines an opening into an engagement recess that is accessible through both the first and second sidewalls. Those portions of the first and second sidewalls that define the carabiner are also spaced apart from one another so as to define an externally accessible gap therebetween.

According to another embodiment, a multipurpose tool is provided that includes a plurality of handles, each extending between first and second opposed ends and configured for movement relative to one another. A first one of the handles defines a pocket opening through a medial portion of the respective handle. The multipurpose tool of this embodiment also includes at least one bit configured to be removably stored within the pocket defined by the first handle. In this regard, the first handle may include a frame and a spring element that is operably connected to the frame for at least partially defining the pocket. The multipurpose tool of this embodiment also includes a plurality of tools carried by at least one of the handles, including a bit driver configured to receive and engage the at least one bit. As such, the multipurpose tool of this embodiment facilitates the storage of one or more bits within a handle so as to reduce the likelihood that the bits will be misplaced in instances in which the bit is not engaged by the bit driver.

In one embodiment, the first handle also includes a spacer for cooperating with the frame and the spring element to define the pocket. The pocket may be defined to have a shape of a rectangular solid. Additionally, the at least one bit may have a corresponding polygonal cross-sectional shape. The first handle may also define a recess that opens into the pocket. The recess may be smaller than the bit, but is sized to permit access to the bit, thereby permitting a user to access the bit via the recess in order to remove the bit from the pocket.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
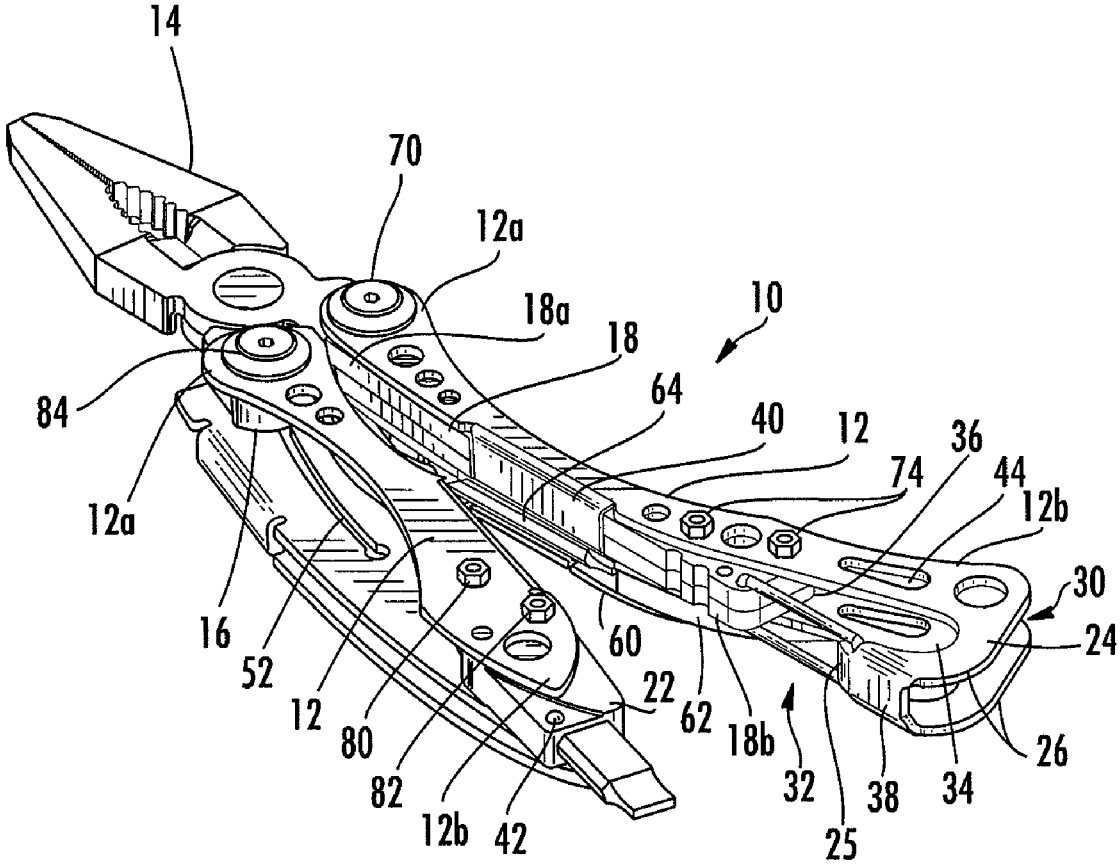
FIG. 1 is a perspective view of a multipurpose tool according to an embodiment of the present invention in the open position.
Figure 2:
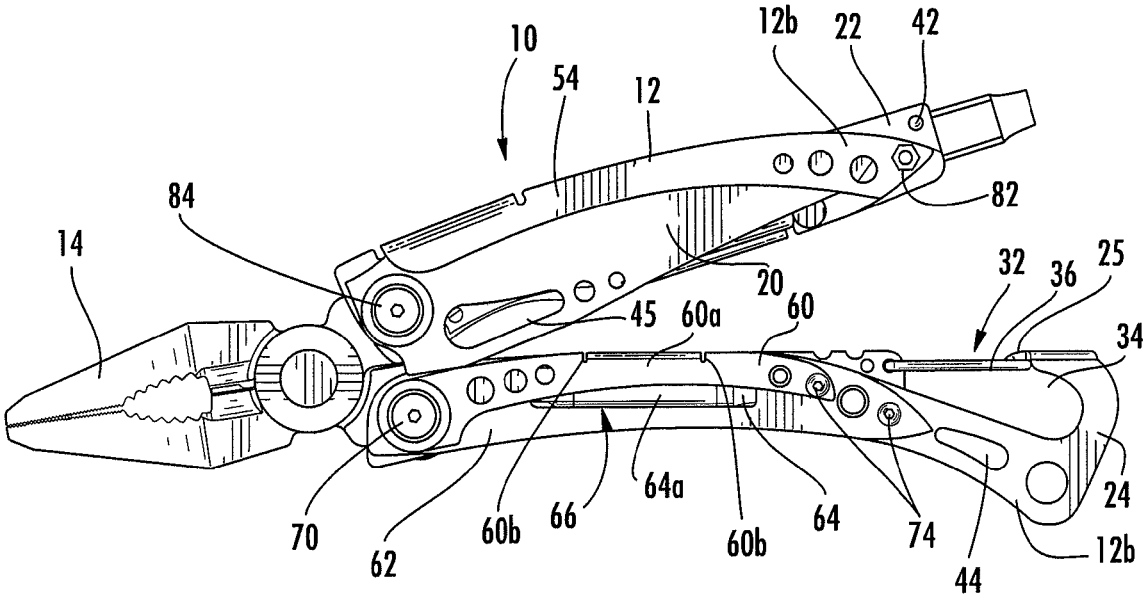
FIG. 2 is a view of a first side of the multipurpose tool of FIG. 1.
Figure 3:
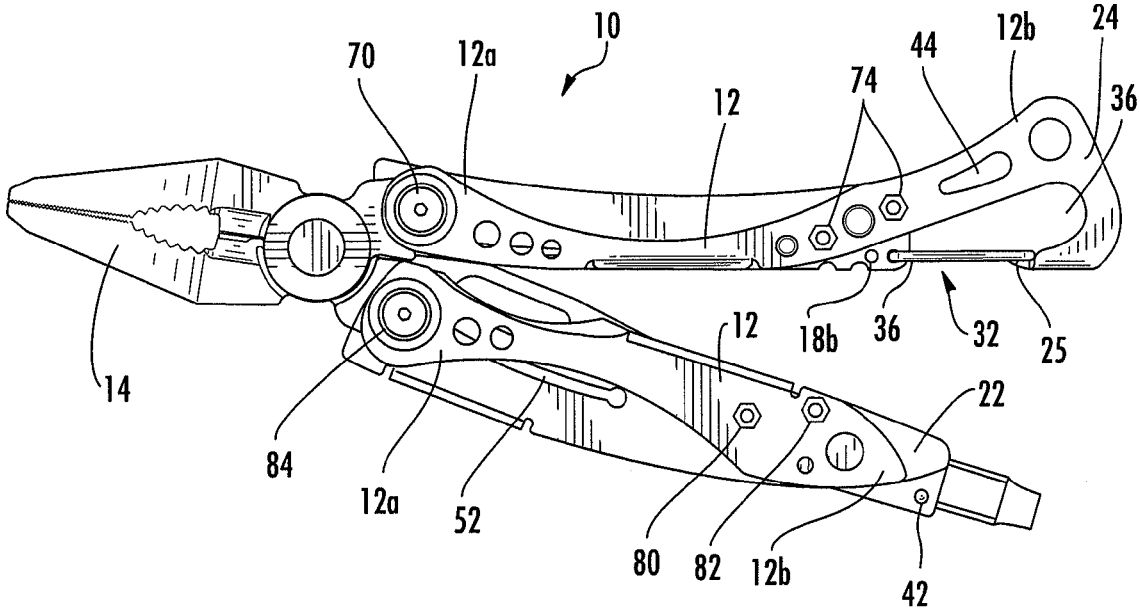
FIG. 3 is a view of a second side of the multipurpose tool of FIG. 1, opposite the first side shown in FIG. 2.

Referring now to FIGS. 1-3, a multipurpose tool 10 according to one embodiment of the present invention is depicted. The multipurpose tool includes a plurality of handles 12 configured for movement relative to one another, as well a plurality of tools carried by at least one of the handles. Typically, the multipurpose tool includes a pair of generally elongate handles that extend between opposed ends 12*a*, 12*b*. As a result of their connection, such a pivotal connection, to one another and/or to one or more of the tools, the handles can be moved toward and away from one another, such as in order to actuate a tool as described below.

Figure 4:
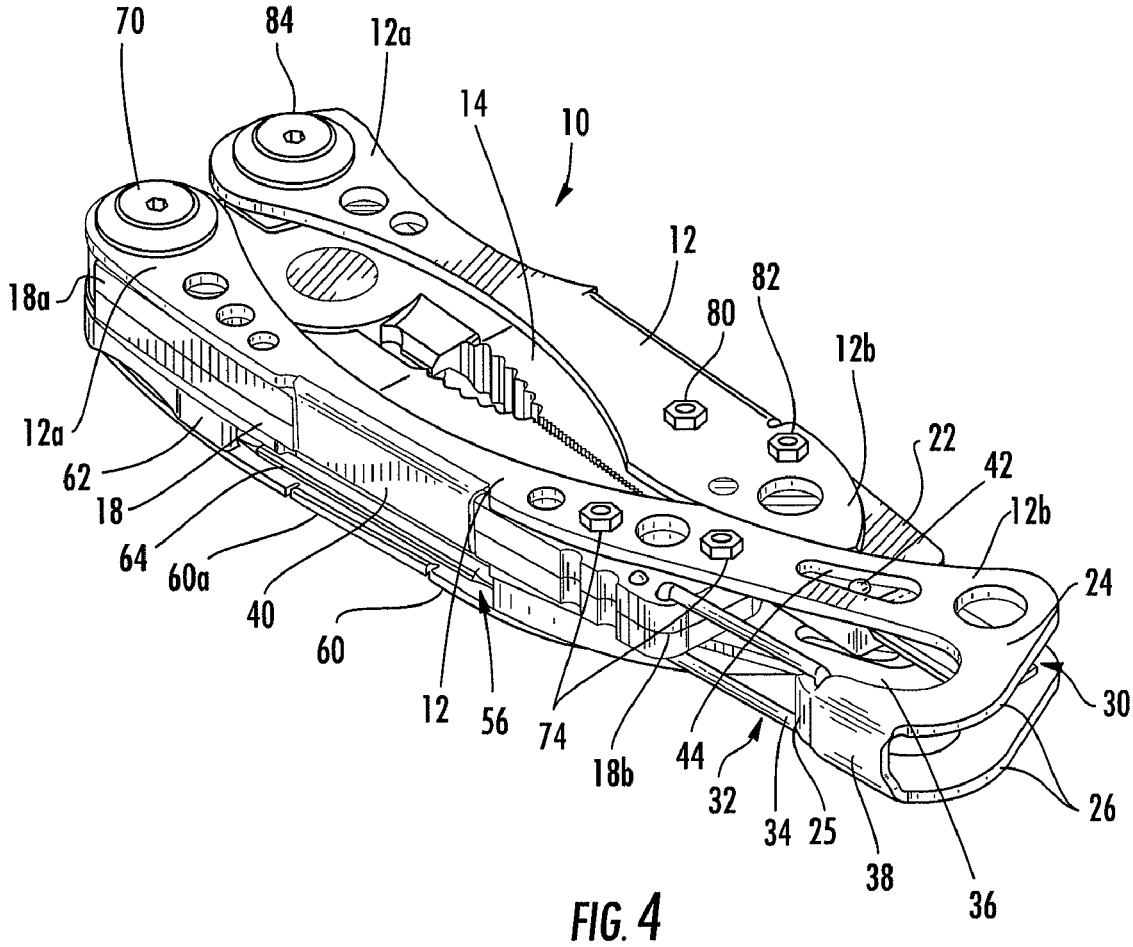
FIG. 4 is a perspective view of the multipurpose tool of FIG. 1 in the closed position.
Figure 5:
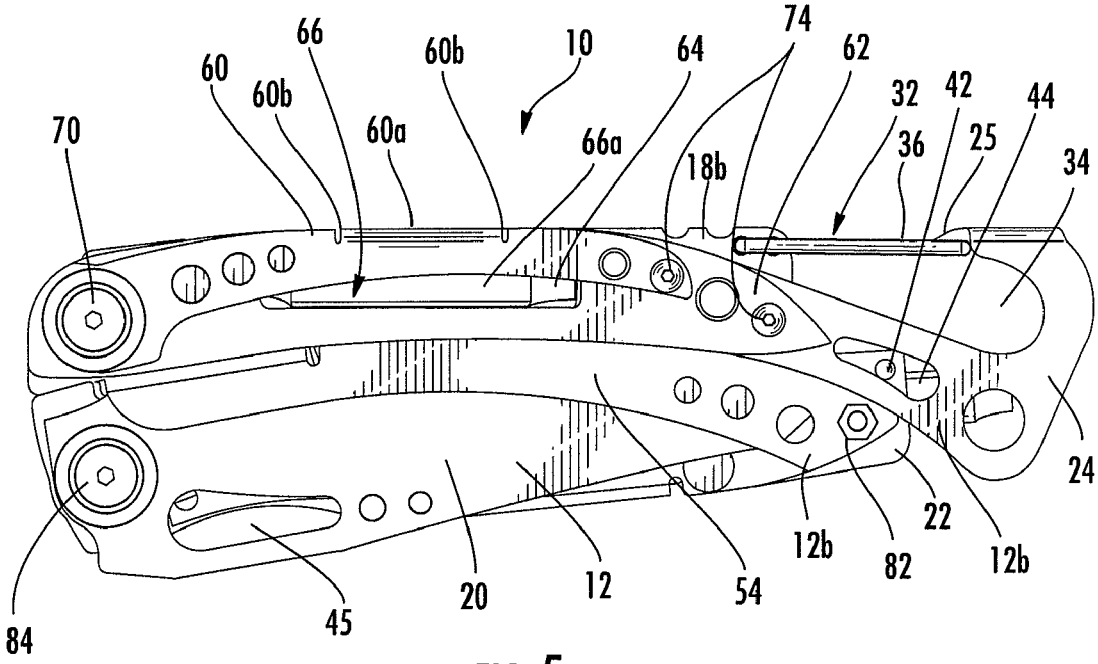
FIG. 5 is a view of a first side of the multipurpose tool of FIG. 4.
Figure 6:
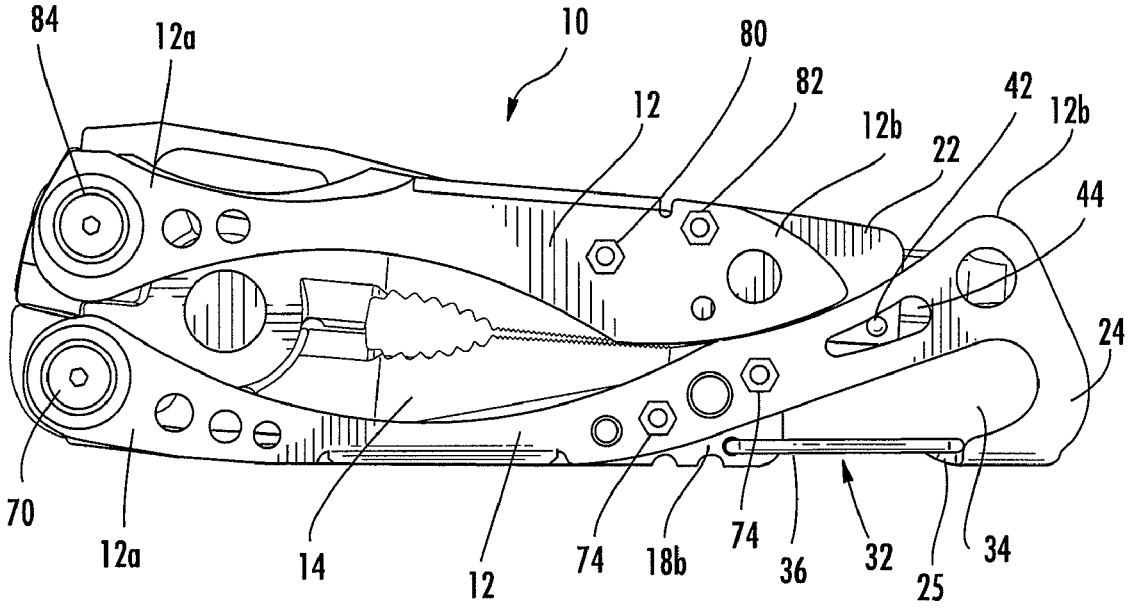
FIG. 6 is a view of a second side of the multipurpose tool of FIG. 4, opposite the first side shown in FIG. 5.
Figure 7:
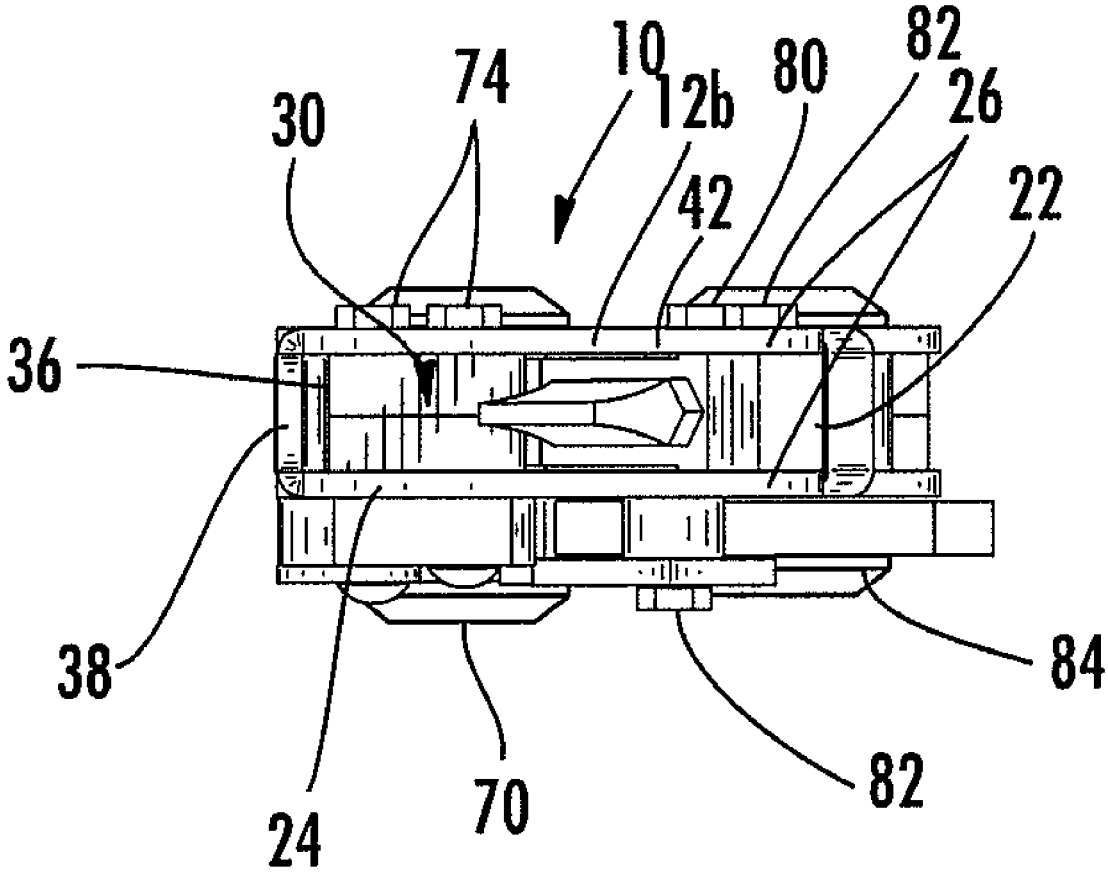
FIG. 7 is an end view of the multipurpose tool of FIG. 4 taken from the right side of FIG. 6.

As also described below, the multipurpose tool 10 may be configured such that the handles 12 are adapted for relative movement between an open position as shown in FIGS. 1-3 and a closed position as shown in FIGS. 4-6 and discussed hereinafter. As will be apparent, the multipurpose tool has a compact form factor in the closed position so as to facilitate transport and storage of the multipurpose tool. While the multipurpose tool is more expansive in the open position, one or more of the tools of the multipurpose tool are accessible and capable of being utilized in the open position, even though those same tool(s) are stowed and generally inaccessible in the closed position.

With reference to FIGS. 1-3, a multipurpose tool 10 of one embodiment may include first and second handles 12 that are connected to the opposed jaws of a tool 14 having pivotable jaws, such as the pliers of the illustrated embodiment. In the open configuration, the handles may be moved toward one another to a position shown in FIG. 1 in order to close the jaws of the pliers and away from one another in order to open the jaws of the pliers. In one embodiment, the jaws of the pliers are configured to contact one another once the jaws are in a fully opened position in order to prevent further opening of the jaws.

Even though the jaws cannot be opened any further, the handles 12 can be pivoted relative to the respective jaws in order to transition from the open position as shown in FIG. 1 to the closed position as shown in FIG. 4. Although the handles may be connected to the jaws in a variety of different manners, the pivotable connection between the handles and jaws may incorporate a camming mechanism in order to bias the handles to remaining in either the open or closed positions. For example, those portions of the jaws that are pivotally connected to the handles may serve as eccentric cams 16 and the handles may include one or more corresponding spring members 18 that ride upon the cams. In one embodiment, each handle may include a pair of spring members for cooperating with the cam to resist the pivotal movement of the handle relative to the respective jaw that is required to initiate the transition from the open position to the closed position or, conversely, from the closed position to the open position without the application of additional force. In the embodiment depicted in FIG. 1, for example, the spring members extend lengthwise along the respective handle and engage the cam of the respective jaw at one end 12*a* of the respective handle. In order to transition the multipurpose tool 10 from the open position to the closed position, force would initially be applied to the handles to move the handles further away from one another until the jaws are fully opened. Then, with the application of an additional and larger force in a direction intended to move the opposite ends 12*b* of the handles further away from one another, the resistance provided by the combination of the cams and the spring members can be overcome with the ends 18*a* of the spring members that are proximate the cams being deflected by the cams relative to the remainder of the handle in order to permit pivotal movement of the handles relative to the jaws.

As will be observed, the cams 16 and the spring members 18 can also be configured to provide a comparable force opposing movement of the multipurpose tool 10 from a closed position to the open position that can be similarly overcome by the application of additional force so as to pivot the handles relative to the jaws. The camming mechanism incorporated into the pivotable connection between the handles 12 and the jaws thereby reduces the unlikelihood that the multipurpose tool will be inadvertently transitioned between the open and closed positions.

The multipurpose tool 10 can include a variety of tools. For example, the multipurpose tool can include a tool 14 having pivotable jaws, such as the pliers described above. Although not heretofore described, the pliers can also include wire cutters and/or wire strippers, if desired. Additionally, the multipurpose tool of the embodiment depicted in FIGS. 1-3 includes a knife blade 20 and a bit drive 22 carried by one of the handles 12. Other embodiments of the multipurpose tool can include these tools and/or other tools, such as a saw blade, bottle opener, can opener, saw, file, razor, gut hook or the like. With reference to the illustrated embodiment, the knife blade can be pivotally connected to one of the handles so as to be unfolded to a deployed position, particularly in instances in which the multipurpose tool is in the closed configuration. Additionally, the bit driver defines a recess that is sized and shaped to snugly receive corresponding bits. As shown, the bit driver may be defined in one end 12*b* of a handle, such as the end of a handle opposite the pivotable connection with the jaw. The bit driver may receive a wide variety of bits including screwdriver bits, torx bits, hex bits, Robertson bits, etc.

The multipurpose tool 10 of this embodiment also includes a carabiner 24 for permitting the multipurpose tool to be removably secured to another object, such as a belt loop, key ring or the like. The carabiner is configured to move in concert with one of the handles 12 and is typically formed by the respective handle, such as at one end 12*b* thereof. As illustrated in FIGS. 1-3, the carabiner is typically formed, not by the handle that carries the bit driver, but by the opposite handle.

As shown in FIG. 1, the carabiner 24 includes first and second sidewalls 26 that are spaced from one another. As will be described hereinafter, the first and second sidewalls also generally define a portion of the handle 12, such as a frame, so as to permit the handle including an integral carabiner to be fabricated in an efficient manner. Thus, the carabiner moves in concert with the handle and is generally not movable relative to the remainder of the handle, i.e., is incapable of movement independent of the remainder of the handle. As shown, the first and second sidewalls are spaced apart from one another such that at least portions of the first and second sidewalls define an externally accessible gap 30 therebetween. As described below, the spacing of the first and second sidewalls and, therefore, the size of the gap therebetween is selected so as to receive, either entirely or at least partially, the tool carried by the other handle, such as the bit driver 22 in the illustrated embodiment.

The carabiner 24 defines an opening 32 into an engagement aperture 34 with the engagement aperture being accessible through both the first and second sidewalls 26. In this regard, the object to which the multipurpose tool 10 is desirably attached may be inserted through the opening into the engagement aperture such that the carabiner is effectively clipped to the object. In order to secure the object within the engagement aperture, the carabiner can also include a gate 36 that extends across the opening defined by the carabiner. While the carabiner can include a variety of gates, the carabiner of one embodiment includes a gate that is pivotally connected, at one end, to the handle 12. In this regard, the gate may be spring loaded so as to close the opening in the absence of any applied force. Although the gate can be pivotally connected to the handle in various manners, the gate of the illustrated embodiment is a rectangular hoop that is pivotally connected to one end 18*b* of the spring members 18 of the handle, namely, the ends of the spring members opposite the camming mechanism. Alternatively, the gate could be pivotally connected to the frame of the handle or to other components of the handle if so desired.

Although the first and second sidewalls 26 are spaced from one another, one or more portions of the first and second sidewalls may be interconnected. For example, portions of the first and second sidewalls proximate the opening 32 defined by the carabiner 24 may be interconnected as indicated by interconnect 38. As discussed hereinbelow in conjunction with an embodiment in which the first and second sidewalls also form the frame of the handle 12, medial portions of the first and second sidewalls may also be interconnected with interconnect 40, albeit at some distance spaced apart from the carabiner. However, other portions of the first and second sidewalls are free of any direct connection, as also discussed below.

While the carabiner 24 may have various orientations relative to the respective handle 12 and, in turn, relative to the multipurpose tool 10, the carabiner of one embodiment is configured such that the opening 32 defined by the carabiner faces inwardly, i.e., faces toward the other handle, in instances in which the multipurpose tool is in the open position as shown in FIGS. 1-3. As such, the transition of the multipurpose tool from the open position to a closed position as shown in FIGS. 4-6 repositions the carabiner such that the opening defined by the carabiner now faces outwardly, i.e., faces away from the other handle, so as to be more easily accessed by the user.

In order to reduce the form factor of the multipurpose tool 10 in the closed position, the carabiner 24 is configured such that a tool carried by the other handle 12, that is, the handle not carrying the carabiner, is at least partially disposed within the carabiner between the first and second sidewalls 26 when the handles are in the closed position. As shown in FIGS. 4-7, for example, the bit driver 22 is at least partially disposed within the carabiner between the first and second sidewalls when the multipurpose tool is in the closed position. As such, the resulting configuration of the multipurpose tool is more compact than if the bit driver did not fold at least partially within the carabiner.

In order to receive the tool, such as the bit driver 22, the carabiner 24 is therefore advantageously configured such that the first and second sidewalls 26 are spaced apart by a distance sufficient to receive the tool, either entirely or partially. Additionally, while portions of the first and second sidewalls may be interconnected, such as by interconnects 38 and 40 discussed above, those portions of the first and second sidewalls that define the gap 30 into which the tool is to be folded are not directly connected and, instead, define an externally accessible gap therebetween. In the embodiment depicted in FIGS. 4-7, for example, the gap into which the tool is folded is defined by those portions of the first and second sidewalls that are positioned on the opposite side of the carabiner from the opening 32 defined by the carabiner. Thus, those portions of the first and second sidewalls that are positioned on the opposite side of the carabiner from its opening are advantageously free of any direct connection that would otherwise restrict the insertion of the tool carried by the other handle into the gap defined by the carabiner.

The carabiner 24 and the tool that folds at least partially within the carabiner can cooperate such that the tool is frictionally engaged by the carabiner when the handles 12 are in the closed position, thereby reducing the likelihood that the multipurpose tool 10 will be inadvertently opened. In one embodiment, for example, the tool or the handle carrying the tool can define a projection 42 that extends outwardly therefrom. The carabiner may define a corresponding recess, such as a corresponding opening 44, for receiving and engaging the projection when the handles are in the closed position. To facilitate the tool's insertion into and withdrawal from the carabiner, the projection is generally sized to make contact with a respective sidewall 26 of the carabiner as the handles are being transitioned to and from the closed position. However, the projection is generally sized to extend only slightly beyond the gap 30 nominally defined by the first and second sidewalls of the carabiner. As such, the respective sidewall can deflect the relatively small amount that is required to permit the tool including the projection to be inserted or withdrawn from the carabiner. In order to facilitate the insertion of or withdrawal of the tool from the carabiner, the projection may have the hemispherical or otherwise rounded end portion. In one embodiment, the tool or the handle carrying the tool may include a pair of projections extending outwardly from opposite sides and the carabiner may accordingly defined respective recesses, such as respective openings, in both the first and second sidewalls for receiving and engaging the respective projections.

In one embodiment, the carabiner 24 may also include an integral bottle opener. As shown, the carabiner may include an inwardly turned lip 25 proximate the opening 32 defined by the carabiner. For example, the lip may be a portion of or proximate to interconnect 38. In order to open a bottle, the bottle cap may be inserted through the opening, thereby displacing the gate 36, such that the lip engages the bottle cap and permits the transfer of force thereto by the user.

Figure 8:
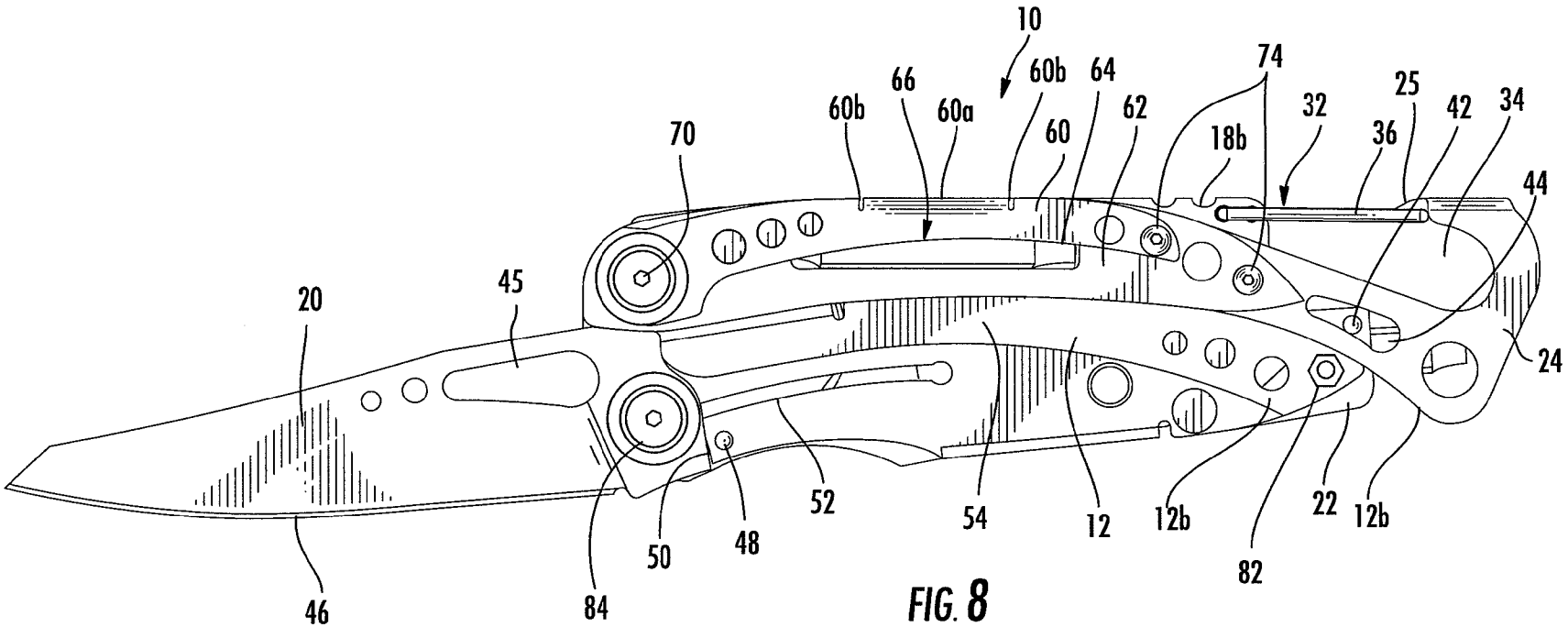
FIG. 8 is a view of the first side of the multipurpose tool of FIG. 4 with the knife blade deployed.

As shown in FIG. 8, the multipurpose tool 10 of the illustrated embodiment can include a knife blade 20 that can be extended, particularly when the multipurpose tool is in the closed position. As shown, the knife blade is configured to pivotally rotate relative to the handle 12 that carries the knife blade. In order to facilitate the rotation of the knife blade from its stowed position, the knife blade can define an opening 45, typically opposite the cutting edge 46, that a user can grasp in order to rotate the knife blade outwardly away from the handle. In order to bias the knife blade to remain in the fully opened position, the multipurpose tool and, in particular, the frame of the handle that carries the knife blade can include a liner lock 48 that engages the rear portion 50 of the knife blade once the knife blade is in the fully opened position. In the illustrated embodiment, the liner lock is carried by a portion of the frame that is partially separated from the remainder of the frame by a slit 52 such that the liner lock is adapted to the flex slightly. As such, the bias provided by the liner lock that serves to maintain the knife blade in the fully opened position can be overcome by the application of a force to the liner lock by the user that causes the liner lock to flex slightly in a direction away from the knife blade and be disengaged from the knife blade. Although not shown, the handle that carries the knife blade can include a projection that engages the leading and/or a medial portion of the knife blade in instances in which the knife blade is folded into the handle in order to reduce the likelihood of inadvertent opening of the knife blade by requiring the application of additional force by the user to overcome the resistance provided by the projection. In order to prevent access to the cutting edge of the knife blade while the knife blade is in a folded position, the handle that carries the knife blade can also include a guard 54 attached or otherwise integral to the frame of the respective handle such that the guard covers the cutting edge of the knife blade while the knife blade is in a folded position.

Figure 9:
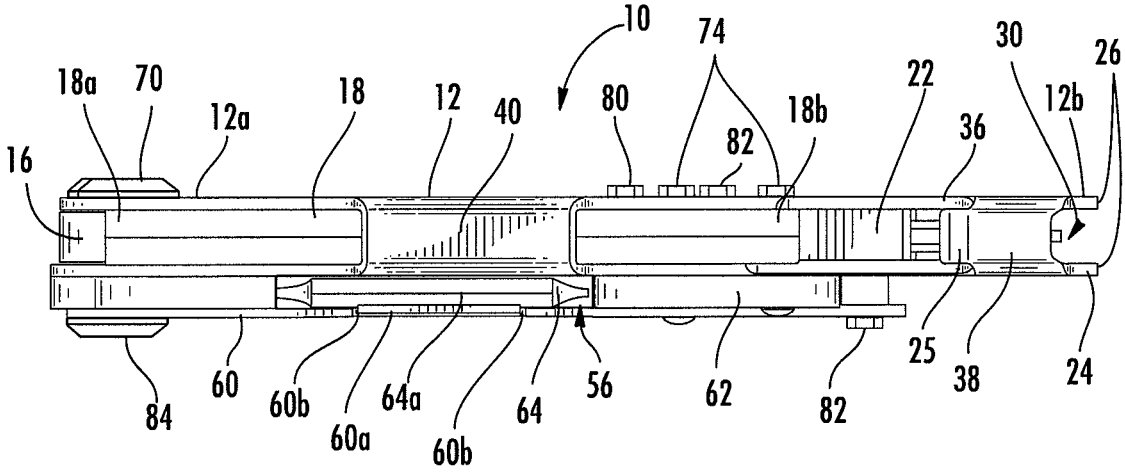
FIG. 9 is a side view of the multipurpose tool of FIG. 4 depicting a bit stored in a pocket defined by one handle taken from the upper side of FIG. 6 and looking downwardly into the multipurpose tool.

As noted above, the multipurpose tool 10 can include a bit driver 22 for engaging corresponding bits, such as screwdriver bits, torx bits, hex bits, Robertson bits, etc. Accordingly, the multipurpose tool of one embodiment is configured to store at least one bit in instances in which the bit is not engaged by the bit driver. As such, extra bits, i.e., bits that are not currently engaged by the bit driver, can be stored by the multipurpose tool itself in order to avoid misplacement of the extra bits. As shown in FIGS. 4 and 9, for example, one of the handles 12 of the multipurpose tool, such as the handle that carries the carabiner 24 in the illustrated embodiment, defines a pocket 56 opening through a medial portion of the respective handle. In this regard, the pocket opens through a portion of the handle spaced apart from either end 12*a*, 12*b* of the handle. In the illustrated embodiment, the pocket defined by the handle opens in such a manner such that the pocket is accessible or exposed when the multipurpose tool is in the closed position. In other words, the pocket defined by the handle faces outwardly, that is, faces away from the other handle, when the multipurpose tool is in the closed configuration. However, other embodiments of the multipurpose tool may include a handle that defines a pocket that opens in other directions, if so desired.

Although the pocket 56 can be formed by the handle 12 in various manners, the handle of one embodiment includes a frame and a spring element 60 operably connected to the frame, such as to one of the first and second sidewalls 26, with the pocket being defined between the spring element and the frame. For example, the frame may define one side surface of the pocket, while the spring element defines the opposed side surface of the pocket. The handle of this embodiment may also include a spacer 62 positioned between the spring element and the frame which defines the remainder of the pocket, such as the opposed end surfaces and the inwardmost surface of the pocket. As described below, the frame, the spacer and the spring member may be connected in various manners, such as by one or more fasteners.

As its name suggests, the spring element 60 is generally a relatively thin plate and is configured to flex or deflect a sufficient amount to permit insertion and withdrawal of the bit 64. While the spring element may be formed of various materials and may, accordingly, have various dimensions, the spring element of one embodiment is formed of hardened stainless steel and has a thickness of 0.010 inches to 0.050 inches and, more particularly, a thickness of about 0.030 inches. In other embodiments, however, the spring element is formed of other metals or plastic materials. Likewise, the other components of the multipurpose tool 10 may be formed of stainless steel or other metallic or plastic materials.

The pocket 56 and the bit 64 may be sized such that the bit fits snugly within the pocket and is frictionally secured therein. For example, the handle 12 may define the pocket to have the shape of a rectangular solid and the shank portion 64*a* of the bit can have a corresponding polygonal shape with opposed major surfaces that frictionally engage the side surfaces of the pocket formed by the spring element 60 and the frame. As shown, the functional tips of the bit can extend from one or both ends of the polygonally shaped shank portion.

The spring element 60 may include additional features to facilitate the competing objectives of flexibility and secure retention of the bit 64. In this regard, a medial portion 60*a* of the spring member that corresponds positionally to the polygonally shaped shank portion 64*a* of the bit may be partially separated from the remainder of the spring element, such as by a pair of slits 60*b*. The medial portion of the spring member may then be bent inward slightly relative to the pocket 56 so as to ensure secure retention of the bit while concurrently being capable of flexing sufficiently to permit insertion and withdrawal of the bit to and from the pocket.

The handle 12 can also define a recess 66 opening into the pocket 56. This recess is generally smaller than the bit 64 such that the bit cannot be inserted or withdrawn through the recess. However, the recess permits a user to touch the bit and to push the bit at least partially out of the pocket. The bit may then be grasped by the user and fully removed from the pocket. As such, the recess is generally positioned such that that portion of the bit that is inserted the furthest, i.e., deepest, into the pocket is exposed. In one embodiment, the recess is defined by a combination of a spring element 60 and the spacer 62 with the spring element only covering a portion of the pocket defined by the spacer and, in particular, only covering that portion of the pocket defined by the spacer that is proximate the opening through which the bit is inserted into and withdrawn from the pocket.

By securely retaining an extra bit 64 within the pocket 56 defined by the handle 12, the extra bit is carried with the multipurpose tool 10 and is readily available to a user if needed. While the multipurpose tool of the illustrated embodiment includes a pocket sized to store a single bit, the handle can define the pocket so as to be larger in order to removably store two or more bits. By disposing the extra bits within a medial portion of the handle, the bits can be advantageously stored without altering the functionality of the multipurpose tool or increasing the size of the multipurpose tool.

Figure 10:
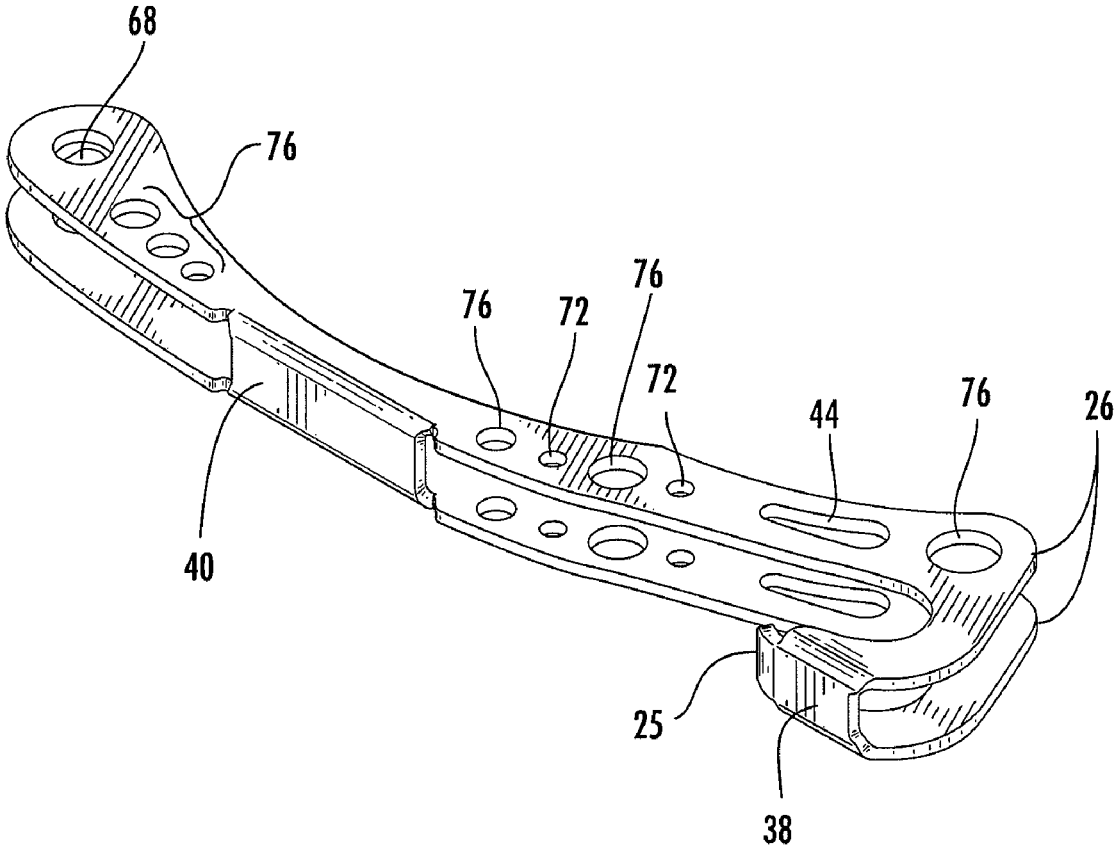
FIG. 10 is perspective view of a frame according to one embodiment of the present invention.

As described above, the handle 12 of one embodiment includes a frame having an integral carabiner 24. As described, the frame of this embodiment includes first and second sidewalls 26 that are operably connected to and spaced apart from one another in such a manner as to form the form the carabiner. While the frame may have various configurations, the frame of one embodiment is depicted in FIG. 10. As shown, the first and second sidewalls are spaced apart from one another and are interconnected by interconnect 38 proximate the opening 32 defined by the carabiner and by interconnect 40 in a medial portion of the frame. As described above, the first and second sidewalls can also define one or more openings, such as opening 44 for receiving corresponding projections 42 of the tool or the handle carrying the tool so as to releasably secure the handles in the closed position. Additionally, the first and second sidewalls can define an opening 68 proximate the end 12*a* of the handle opposite the carabiner for receiving a fastener 70 that secures the handle to a respective jaw and defines the axis about which the handle pivots with respect to the respective jaw.

Figure 11:
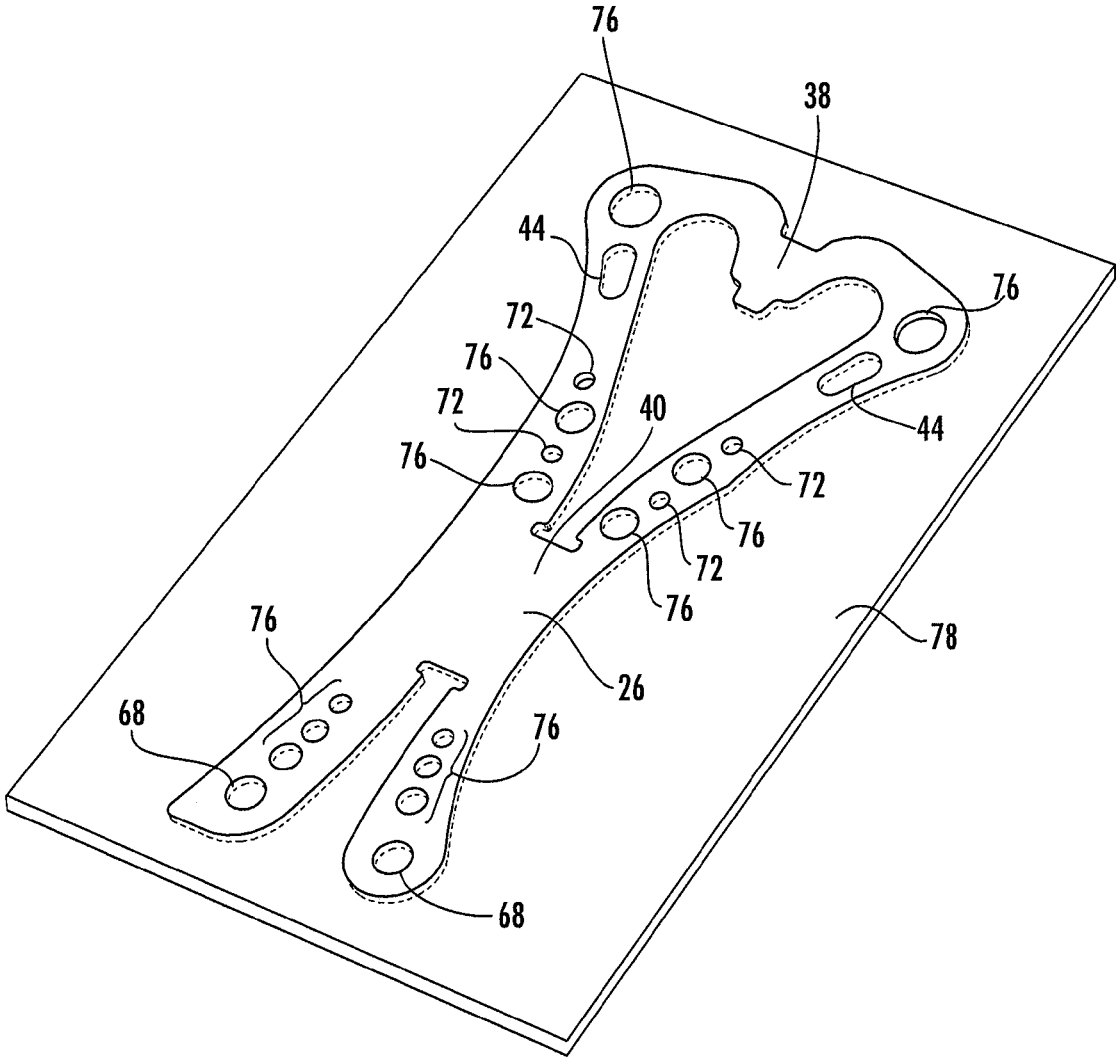
FIG. 11 is a perspective view illustrating the stamping of the frame of FIG. 10 from a workpiece in accordance with one embodiment of the present invention.

The first and second sidewalls 26 of the frame can also define one or more openings 72 for receiving fasteners 74 for securing the frame to one or more spring members 18 and, more typically, to the end 18*b* of the spring members opposite the camming mechanism. As shown in FIGS. 10 and 11, the first and second sidewalls can optionally define additional openings 76 to reduce the resulting weight of the frame and, in turn, the multipurpose tool 10 as well as to correspondingly reduce the material requirement.

In order to construct one embodiment of the handle 12 that carries the carabiner 24, one or more spring members 18 may be positioned between the first and second sidewalls 26 of the frame. In this regard, the spring members may be positioned such that openings defined by the end 18*b* of the spring members opposite the camming mechanism are aligned with corresponding openings 72 defined by the frame. The spring members may then be secured to the frame by means of fasteners 74 that extend through the aligned openings. The other end 18*a* of the spring members has no direct connection to the frame so as to permit deflection of the spring members as the spring members contact and ride upon the cams of the jaws. As described above, the end 18*b* of the spring members that is connected to the frame may also carry the gate 36 that extends across the opening 32 defined by the carabiner.

In the embodiment in which the multipurpose tool 10 defines a pocket 56 for storing extra bits 64, the spacer 62 and the spring element 60 may also be attached to one of the first or second sidewall 26, such as an exterior facing surface of the one of the sidewalls as shown in FIGS. 2, 5, 8 and 9. For example, the spacer and the spring element can define respective openings that are aligned at one end with corresponding openings 72 defined by the frame and at the other end with opening 68 that is also defined by the frame. As such, the spacer and the spring element can be secured to the frame with the fasteners 74 that were described above to extend through openings 72. Finally, the handle including the frame, spring members 18, spacer and spring element may be attached to the respective jaw via a fastener 70 that extends through the openings aligned with frame openings 68 and establishes an axis about which the handle pivots with respect to the jaw. Although not illustrated, the multipurpose tool may also include a belt clip that can be secured to the handle with fastener 70, if desired.

In embodiments in which the carabiner 24 is integral with the remainder of the frame, the frame including the carabiner can be fabricated in an efficient manner. In this regard, the frame may be stamped, such as by fine blanking, from a workpiece 78 as shown in FIG. 11. The frame that is stamped from the workpiece includes first and second interconnected frame portions. The frame is then removed from the remainder of the workpiece and bent so as to align the first and second interconnected frame portions to thereby define corresponding first and second sidewalls 26 that are spaced apart from one another as shown in FIG. 10. While the frame may be bent in various fashions, the frame may be bent about a form, if desired. In the process of stamping the workpiece and bending the frame, the carabiner is formed and is defined by portions of the first and second sidewalls as described above. As such, the frame can be fabricated in an efficient manner and can include not only the structural features of the frame, but also the carabiner proximate one end thereof.

The other handle 12 of the multipurpose tool 10 of the illustrated embodiment may be constructed in an analogous manner. In this regard, the handle can include a frame, such as a frame formed by stamping and bending as described above, that includes first and second sidewalls 26 that are spaced apart from one another as well as the guard 54 that covers the cutting edge 46 of the knife blade 20 in instances in which the knife blade is in the folded position. Although spaced apart, the first and second sidewalls and the guard are also interconnected to one another to define an integral structure. One or more spring members 18 may be disposed between the first and second sidewalls and secured thereto, such as with one or more fasteners 80 positioned proximate one end 18*b* of the spring members. Additionally, the bit driver 22 may be positioned between the first and second sidewalls proximate one end thereof and secured to the frame by one or more fasteners 82. An assembly consisting of the frame, the spring members, the bit driver and the knife blade is then pivotally connected to the respective jaw by means of a fastener 84 that extends through aligned openings defined by the frame and the knife blade to define the axis about which the handle will rotate relative to the respective jaw.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A multipurpose tool comprising:

a plurality of handles that extend in respective lengthwise directions between opposed ends and are configured for relative movement between a closed position and an open position, wherein at least a first one of the handles is formed from a single integral piece of material and comprises first and second sidewalls spaced apart from one another to define a gap therebetween and joined by at least one interconnect;

a plurality of tools carried by at least one of the handles, wherein at least one of the tools is configured to be folded at least partially into the gap defined by the first one of the handles; and a carabiner formed by a portion of the first and second sidewalls that also form the first one of the handles and are spaced from one another, wherein the carabiner is configured to extend outwardly in the lengthwise direction from all other portions of the first one of the handles in both the open and closed positions, and wherein the carabiner is configured to move in concert with the first one of the handles such that a tool carried by another handle is at least partially disposed within the carabiner between the first and second sidewalls of the first one of the handles when the handles are in the closed position and the carabiner is extending outwardly from all other portions of the first one of the handles.

2. A multipurpose tool according to claim 1 wherein the carabiner is formed by the first handle.

3. A multipurpose tool according to claim 2 wherein the carabiner is disposed at one end of the first handle.

4. A multipurpose tool according to claim 1 wherein the carabiner defines an opening into an engagement aperture that is accessible through both the first and second sidewalls.

5. A multipurpose tool according to claim 4 wherein the carabiner is configured to receive the tool carried by another handle between portions of the first and second sidewalls that are positioned opposite the opening defined by the carabiner.

6. A multipurpose tool according to claim 4 wherein the carabiner further comprises a gate extending across the opening defined by the carabiner.

7. A multipurpose tool according to claim 4 wherein the first and second sidewalls are interconnected proximate the opening defined by the carabiner.

8. A multipurpose tool according to claim 1 wherein the tool carried by another handle that is at least partially disposed within the carabiner when the handles are in the closed position comprises a bit driver.

9. A multipurpose tool according to claim 1 wherein the tool carried by another handle that is at least partially disposed within the carabiner when the handles are in the closed position is disposed at one end of the respective handle.

10. A multipurpose tool according to claim 1 wherein the plurality of tools are selected from the group consisting of pliers, a bit driver and a knife blade.

11. A multipurpose tool according to claim 1 wherein the carabiner and the tool carried by another handle cooperate such that the tool is frictionally engaged by the carabiner when the handles are in the closed position.

12. A multipurpose tool according to claim 11 wherein at least one of the tool or the handle carrying the tool comprises a projection, and wherein the carabiner defines a corresponding recess for engaging the projection when the handles are in the closed position.

13. A multipurpose tool according to claim 1 wherein the carabiner has a fixed positional relationship relative to other portions of the first handle.

14. A multipurpose tool comprising:

a plurality of handles extending between opposed first and second ends and configured for movement relative to one another, wherein a first one of the plurality of handles comprises a frame and a spring element operably connected to the frame, wherein the frame and the spring element cooperate to define a pocket opening through a medial portion of an external surface of the respective handle, and wherein the spring element comprises a plate extending across the pocket by extending across an opening through the medial portion of the external surface of the respective handle and operably connected to the frame on at least one side of the pocket, wherein the plate includes a medial portion and defines a pair of slits that partially separate the medial portion from other lateral portions of the plate, wherein the frame is formed of a single piece of material which forms first and second sidewalls, wherein the first handle further comprises at least one spacer extending alongside one of the first and second sidewalls and operably connected to the frame and the spring element, wherein the spacer cooperates with the frame and is in partial alignment with the spring element to define the pocket;

at least one bit configured to be removably stored within the pocket defined by the first handle and engaged by the medial portion of the plate; and a plurality of tools carried by at least one of the handles, wherein the plurality of tools comprises a bit driver configured to receive and engage the at least one bit.

15. A multipurpose tool according to claim 14 wherein the first handle defines the pocket to have a shape of a rectangular solid.

16. A multipurpose tool according to claim 14 wherein at least a portion of the at least one bit has a polygonal cross-sectional shape.

17. A multipurpose tool according to claim 14 wherein the first handle further defines a recess opening into the pocket, wherein the recess is smaller than the at least one bit but permits access to the at least one bit.

18. A multipurpose tool according to claim 14 wherein the first handle extends in a lengthwise direction between the opposed first and second ends, wherein the pocket is defined to extend in the lengthwise direction, and wherein the plate spans across the pocket in the lengthwise direction.

19. A multipurpose tool according to claim 14 wherein the frame and the plate cooperate to define a recess into the pocket, wherein the recess is distinct from the opening of the pocket through the medial portion of the respective handle.

20. A multipurpose tool according to claim 14 wherein the plate is connected to the frame on each side of the pocket.

21. A multipurpose tool according to claim 14 wherein the medial portion of the plate is bent inward relative to the pocket.

* * * * *